US005685394A

United States Patent [19]

Simson

[11] Patent Number: 5,685,394

[45] Date of Patent: Nov. 11, 1997

[54] AUTOMATIC BLOCKADING SYSTEM DEVICE FOR LADDERS OR FOLDING PORTABLE STEPLADDER IN TRANSVERSAL SENSE

[76] Inventor: Bruce Norman Unwin Simson, Postal Address 10, Lluchmajor (Baleares), Spain

[21] Appl. No.: 413,220

[22] Filed: Mar. 28, 1995

[30] Foreign Application Priority Data

Mar. 29, 1994 [ES] Spain ..... 9400681/4

[51] Int. Cl.[6] ..... F06C 1/00

[52] U.S. Cl. ..... 182/159; 182/160

[58] Field of Search ..... 182/159, 160, 182/96

[56] References Cited

U.S. PATENT DOCUMENTS

| | | | |
|---|---|---|---|
| 400,778 | 4/1889 | Lowe et al. | 182/160 |
| 1,054,108 | 2/1913 | Garraway | 182/160 |
| 1,085,563 | 1/1914 | Garraway | 182/160 |
| 2,088,878 | 8/1937 | Stogner | 182/162 |
| 2,727,671 | 12/1955 | Ollerhead | 182/160 |
| 2,981,364 | 4/1961 | Webber | 182/159 |
| 3,084,760 | 4/1963 | Lamberti | 182/160 |
| 3,259,207 | 7/1966 | Schoeffler | 182/96 |
| 4,016,954 | 4/1977 | Hickman | 182/160 X |
| 4,042,991 | 8/1977 | Macy et al. | 182/159 X |
| 4,560,030 | 12/1985 | Muscelli | 182/160 X |
| 4,569,419 | 2/1986 | Stolz | 182/160 |

FOREIGN PATENT DOCUMENTS

| | | | |
|---|---|---|---|
| 1403008 | 4/1964 | France . | |
| 2923397 | 12/1979 | Germany | 182/159 |
| 542686 | 4/1956 | Italy | 182/160 |

*Primary Examiner*—Terry Lee Melius
*Assistant Examiner*—Thomas A. Beach
*Attorney, Agent, or Firm*—Dennison, Meserole, Pollack & Scheiner

[57] ABSTRACT

A pair of laterally positioned struts are interconnected by a plurality of rungs, each rung being formed of a pair of pivotally mounted rung sections. A central rod extends between the inner ends of the rung sections of each rung, the central rod being rigid with a fastener member beneath each pair of rung sections. The inner ends of each pair of rung sections are individually pivoted to a fastener member. A pair of diverging stabilizing rods are centrally joined to a joinder member slidably on the central rod and positionable in direct underlying and supporting engagement with the fastener member of the lowermost rung in the open position of the ladder.

2 Claims, 2 Drawing Sheets

AUTOMATIC BLOCKADING SYSTEM DEVICE FOR LADDERS OR FOLDING PORTABLE STEPLADDER IN TRANSVERSAL SENSE

BACKGROUND OF THE INVENTION

Folding ladders, whether straight ladders or stepladders, are well known in the art, such ladders collapsing laterally with the parallel struts moved inwardly toward each other and with the rungs collapsing therebetween. An example of such a ladder will be seen in French Patent No. 1.403.008, issued May 10, 1965, to MM. Albert Communal and Jean-Louis Communal.

Folding ladders of the type illustrated in the French patent are particularly useful in providing for a ladder which can be effectively collapsed to a compact configuration of a width substantially no greater than that of the two side struts themselves.

However, a particular problem found with such ladders is the lack of stability and rigidity in its open or working position. As noted in the schematic illustrations in FIGS. 1 and 1(A) of a prior art ladder such as in the French patent, there is a substantial tendency for such ladders to rock or sway laterally. A further problem with the prior art ladders is illustrated in FIG. 2 wherein an uneven base or ground situation might in fact cause a partial collapse of the ladder with one strut moving inwardly against the center bar.

SUMMARY OF THE INVENTION

The present invention provides a unique stabilization system which automatically engages upon an outward movement of the struts to the open position on the ladder, with the stabilization system operative in conjunction with the struts and rungs to overcome the problems of stability which heretofore substantially reduced the effectiveness of similar collapsible ladders.

It is significant that the stabilization system of the invention, incorporated into the basic ladder construction, does not interfere with the desired compacting of the ladder to the smallest possible volume, thus in effect substantially enhancing the utility and practicality of collapsible ladders without adding to the collapsed bulk thereof.

The ladder with the stabilization system of the invention guarantees the perfect symmetry of the erected ladder, preventing an oblique deformation thereof as schematically illustrated in FIGS. 1 and 1(A), and substantially increasing the safety of the ladder.

Another object of the invention is to provide a stabilization system which provides increased strength and mechanical resistance to any tendency for the two-section rungs to collapse at the folding centers thereof.

Basically, the objects of the invention are achieved by a unique ladder construction which includes a plurality of rungs extending between parallel side struts with each rung comprising a pair of separate aligned rung sections having the respective outer ends thereof pivotally joined to the corresponding struts, and inner ends separately pivotably joined to a central fastener member. The fastener members are in turn separately fixed to an elongate central bar parallel to the struts. The central bar provides for a simultaneous movement of the rung sections.

A stabilizing assembly is provided beneath the lowermost rung and includes a pair of elongate stabilizing rods, each having a lower end pivotally joined to the lower ends of the struts, and an upper end pivotally joined to a joinder member freely slidable on the central bar with the joinder member in the open position of the ladder abutting beneath the fastener member and the inner ends of the rung sections of the lowermost rung for a retention of these rung sections in linear alignment.

Other features of the invention will become apparent from the more detailed description of the invention following hereinafter.

DESCRIPTION OF PREFERRED EMBODIMENTS

Figure 1:
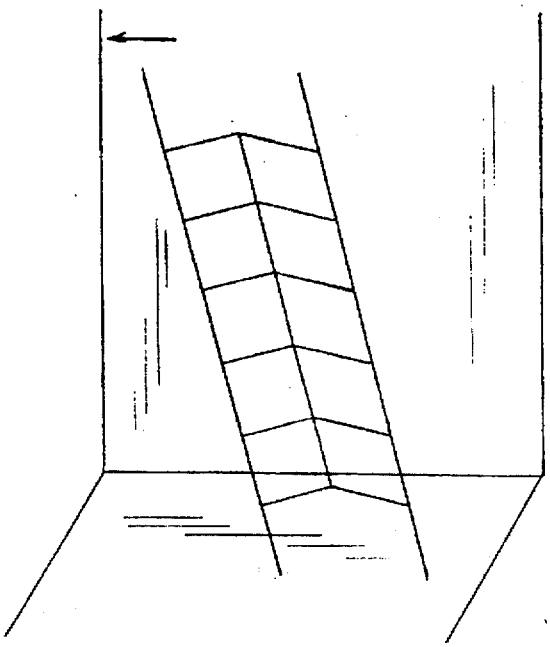
FIG 1 PRIOR ART
FIGS. 1 and 1(A) are schematic showings of prior art ladders illustrating the lack of stability thereof.
Figure 1A:
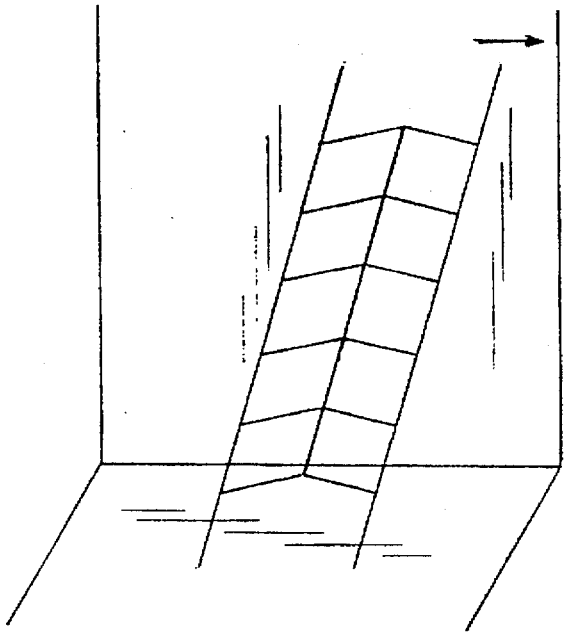
FIG 1(A) PRIOR ART
Figure 2:
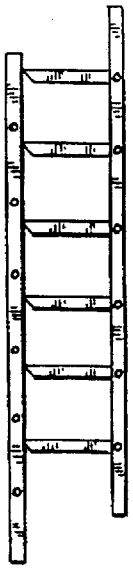
FIG 2 PRIOR ART
FIG. 2 is a schematic illustration of a partially collapsed prior art ladder.
Figure 3:
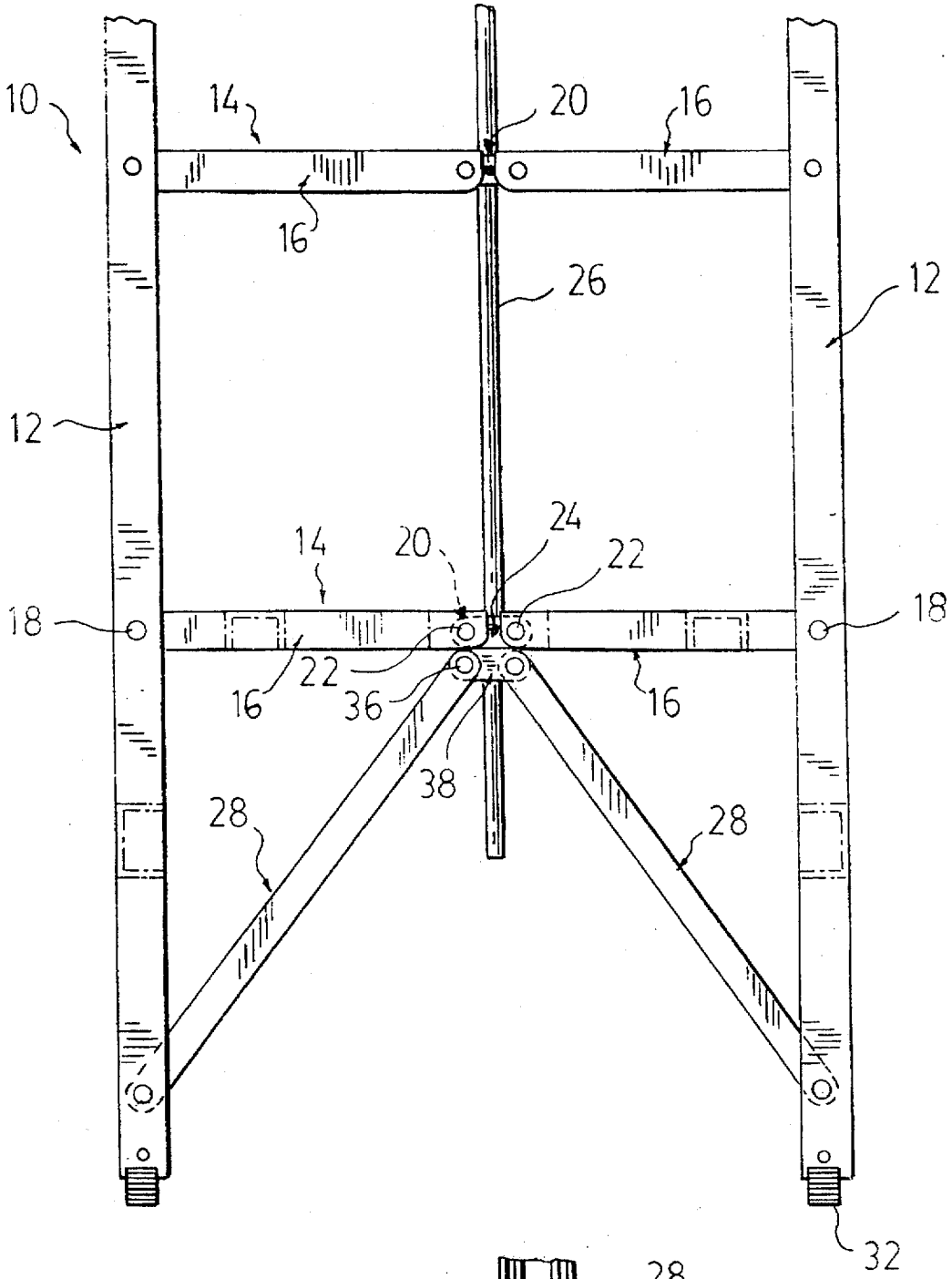
FIG. 3 is an elevational view of the lower portion of a folding ladder incorporating the features of the invention.
Figure 4:
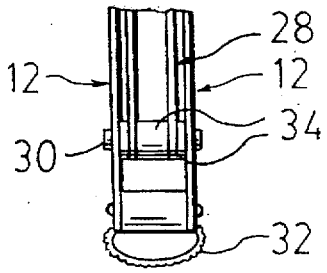
FIG. 4 is an elevational detail illustrating the pivotal mounting of the lower end of a stabilizing rod to a strut.

Referring now more specifically to the drawings, and in particular FIGS. 3 and 4, the ladder 10 of the invention includes a pair of laterally spaced vertically elongate struts 12. These struts 12, as illustrated, are preferably U-shaped in cross section with the formed channels opening inwardly toward each other.

A plurality of rungs 14 extend between the struts 12 at vertically spaced points therealong. Each of the rungs 14 is formed of a pair of separate aligned rung sections 16. The rung sections 16, also channel shaped or U-shaped as illustrated, define downwardly open channels and are of a size for folding reception within the channels of the struts 12.

The outer end of each rung section 16 is received within a corresponding strut 12 and secured thereto for pivotal movement in a vertical plane by a transverse pivot pin 18.

The inner ends of the rung sections 16 of each rung 14 receive the opposite end portions of a fastener member 20 telescopically therein with a separate pivot member or pin 22 joining each rung section inner end to the corresponding fastener member 20 for independent pivotal movement relative thereto. The fastener members 20 are in turn fixed, by appropriate means such as a lock pin or set screw 24, to a vertically elongate bar 26 paralleling the struts 12 and centrally therebetween for vertical alignment with the fastener members 20 interconnecting the rung sections 16 of each rung 14. So formed, the rungs will simultaneously fold and extend with the central bar 26 appropriately moving upward and downward. In one embodiment, the bar 26 can be in the form of a cylindrical rod received through and pinned within central apertures in the fastener members 20. It will be recognized that the inner ends of adjacent rungs 16 are spaced or appropriately configured relative to each other for reception of the central bar 26 therebetween. Further, and noting the lowermost rung 14 in FIG. 3, the inner end portions of the downwardly opening rung sections 16 engage and are supported on the corresponding fastener member 20 in the fully open or in use position of the rung 16 and ladder 10.

The stabilization of the ladder 10 is achieved, in conjunction with the above described construction, by a stabilizing assembly comprising a pair of elongate stabilizing rods 28, also preferably of a U-shaped configuration with the channel therein opening downwardly and inwardly as the rods 28, in the open or in-use position of the ladder, extend between the lower ends of the struts 12 to a point immediately underlying the inner ends of the first pair of rung sections 16. The stabilizing rods 28, while substantially longer than the rung sections 16, have a smaller profile for nested reception within the rung sections and struts upon a folding of the ladder. Noting the detail of FIG. 4, the lower end of each of the stabilizing rods 28 is received within and pivotally secured to the lower portion of the corresponding strut 12 by a transverse pivot pin 30 at a point slightly above the lower foot 32 of the strut 12. As desired, appropriate spacers or blocks 34 can be provided for retaining the pivotally mounted lower end of the stabilizing rod 28 centrally within the strut 12.

The upper ends of the two stabilizing rods 28 are in turn pivoted, by separate pivot means 36, to the opposed ends of a joinder member 38. Such pivot means can be in the nature of pivot pins, also designated by reference numeral 36. Preferably, the joinder member 38 is received within the opposed open upper ends of the stabilizing rods 28. This joinder member 38 is freely slidable on the central bar 26. The length of the stabilizing rods 28 is such that, in the open or in-use position of the ladder, the lowermost fastener member 20 and the supported inner ends of the rung sections 16 of the lowermost rung 14 directly engage thereon and are further supported thereby for retention of the lowermost rung sections in linear alignment. Similarly, by thus stabilizing the central bar 26, all of the other rungs are stabilized with the corresponding rung sections linearly aligned. Any weight applied to the rungs by a user of the ladder will ultimately be supported by the lower portions of the struts through the stabilizing rods 28, the struts 12 in turn being laterally fixed in position by the linearly positioned rung sections 16.

When the ladder 10 is to be folded, a push upward on the central bar 26 will upwardly move the fastener members 20, causing an upward folding of the rung sections 16 of each rung 14 and a corresponding inward drawing of the struts 12. As the struts are inwardly drawn, the joinder member 38, individually pivotably mounting the upper ends of the stabilizing rods 28, will slide upward on the central rod 26 and neatly fold within the channel-shaped configurations of the lowermost rung sections as these rung sections are in turn folded within the opposed channel-shaped struts. The relationship between the length of the rung sections 16 and the stabilizing rods 28 are such as, upon a folding or collapsing of the ladder, to upwardly pivot the lowermost rung 14 upward relative to and out of contact with the joinder member 38 mounting the upper ends of the stabilizing rods 28. In opening or unfolding the ladder to the in-use position, one need merely pull the struts 12 laterally apart and, when accessible between the struts, downwardly moving the central rod 26 or downwardly pivot one of the rungs.

While the invention has been set forth in terms of a straight ladder, the concepts thereof can also be adapted to stepladders and like supports wherein lateral collapsibility is desired in conjunction with a high degree of stability when open to preclude any accidental side shifting. In addition, while various components have been defined as rods, bars, and the like, such terms are considered to encompass other equivalent forms of structural members which can reasonably be utilized in the formation of a ladder incorporating the features of the invention.

The foregoing is considered illustrative of the principles of the invention which are considered to encompass such modifications as may reasonably be considered to fall within the scope of the claims following hereinafter.

I claim:

1. A ladder comprising a pair of laterally positioned substantially parallel elongate struts with opposed upper and lower ends, a plurality of rungs extending between said struts at spaced points therealong, said rungs each having opposed outer ends, pivot means joining each rung outer end to a corresponding strut, each of said rungs comprising a pair of separate aligned rung sections respectively extending inward from the opposed outer ends thereof and terminating in inner rung section ends, a central bar parallel to said struts centrally therebetween and movable between a lower in use position and an upper collapsed position, a fastener member between said inner ends of each pair of rung sections, separate pivot members joining said inner ends of each pair of rung sections to the corresponding fastener member, separate means fixing each fastener member to said central bar for movement therewith and for selective movement of said rung sections of each rung between a linear alignment in said in use position with said struts laterally remote from each other, and a generally parallel orientation in said collapsed position adjacent said central bar and with said struts laterally adjacent each other, said inner ends of each pair of rung sections being laterally spaced from each other in said in use position, and stabilizing means joined to said struts below a lowermost one of said rungs, said stabilizing means, in said in use position, extending into supporting engagement with the lowermost one of said rungs thereabove for stabilizing said struts and said rungs wherein lateral shifting of said struts and rungs is precluded, said stabilizing means including a pair of elongate stabilizing rods below said lowermost one of said rungs, each rod having a lower end and an upper end, a joinder member between said upper ends of said rods, means pivotally joining each of said rod upper ends to said joinder member, said joinder member being freely slidable on said central bar, and means pivotally joining said rod lower ends, one to each of said struts, wherein movement of said central bar relative to said struts between said in use position and said collapsed position effects a corresponding pivotal movement of said rung sections and a lateral movement of said struts, said lateral movement of said struts effecting a pivotal movement of said stabilizing rods, said joinder member, in said in use position, abutting beneath the inner ends and the fastener member of the rung sections of the lowermost rung for retention of the rung sections of each rung in linear alignment.

2. The ladder of claim 1 wherein said fastener members are received within and at least partially concealed by the corresponding rung section inner ends.

* * * * *